US007731594B1

(12) United States Patent
Hansen

(10) Patent No.: US 7,731,594 B1
(45) Date of Patent: Jun. 8, 2010

(54) CONCAVE MARTIAL ARTS PLATFORM WITH INCLINED CONSTRAINT NET

(76) Inventor: Christopher L. Hansen, P.O. Box 4898, Chatsworth, CA (US) 91313

( * ) Notice: Subject to any disclaimer, the term of this patent is extended or adjusted under 35 U.S.C. 154(b) by 228 days.

(21) Appl. No.: 11/894,292

(22) Filed: Aug. 22, 2007

(51) Int. Cl.
*A63C 19/02* (2006.01)
*A63C 19/12* (2006.01)

(52) U.S. Cl. ..... 472/93; 472/94

(58) Field of Classification Search ..... 472/88–94, 472/136, 137; 482/27, 28
See application file for complete search history.

(56) References Cited

U.S. PATENT DOCUMENTS

| | | | | | |
|---|---|---|---|---|---|
| 959,973 | A * | 5/1910 | Tomkins | 472/94 |
| 1,091,484 | A * | 3/1914 | Cohn | 472/89 |
| 1,753,328 | A | 4/1930 | Barnes | |
| 2,119,327 | A | 5/1938 | Gunnarson | |
| 2,243,943 | A | 6/1941 | Bunting | |
| 2,726,866 | A | 12/1955 | Nally | |
| 3,876,197 | A | 4/1975 | Jensen | |
| 4,557,475 | A * | 12/1985 | Donovan | 472/92 |
| 5,182,824 | A * | 2/1993 | Cipriano | 5/2.1 |
| 5,634,638 | A | 6/1997 | Havens et al. | |
| 6,017,292 | A * | 1/2000 | Gift et al. | 482/27 |
| 6,679,811 | B2 * | 1/2004 | Chen | 482/29 |

* cited by examiner

*Primary Examiner*—Kien T Nguyen
(74) *Attorney, Agent, or Firm*—J. E. McTaggart

(57) ABSTRACT

A platform for performance of personal combat martial arts is made with a concave upper surface having a central generally flat region for main performance surrounded by a border region that slopes upwardly to the platform periphery, so that instead of the traditional impasse and fight interruption experienced when a combatant is forced into the border region, ropes or corners of conventional flat fight rings, the action tends to continue and automatically gravitate back into the main central region without interruption. A full-height constraint net that slopes upwardly and inwardly further urges combatants away from the periphery and safely prevents bodily ejection, thus protecting ringside spectators while providing all spectators with a good view of the sports action.

11 Claims, 4 Drawing Sheets

CONCAVE MARTIAL ARTS PLATFORM WITH INCLINED CONSTRAINT NET

FIELD OF THE INVENTION

The present invention is in the field of personal combative spectator sports of the type conventionally presented with the combatants performing on a flat platform known as a boxing, wrestling or martial arts "ring" or "cage" typically located in a central region of a sports arena. More particularly, in a radical departure from the conventional sports "ring" or "cage" with the traditional flat platform and surrounding constraint structure such as ropes suspended from corner-posts extending substantially vertically to about waist or chest height, the present invention is directed to advancement in basic combat performance apparatus and underlying philosophy in evolving forms of personal combat sports generally in the field of endeavor known as the martial arts but not restricted thereto.

BACKGROUND OF THE INVENTION

The conventional square "rings" that have become standard over a long period of time for boxing and wrestling and more recent "cages" for grappling and other martial arts are intended to contain the fighting action within the roped or fenced area and protect the spectators to some extent while providing the spectators with a good view of the action. The conventional flat platform, usually covered with a fabric or plastic mat, is located at a designated height above the surrounding floor at an elevation that has been selected to be as optimal as possible for the majority of spectators, but inherently with some view impairment and risk to ringside viewers.

DISCUSSION OF KNOWN ART

U.S. Pat. No. 2,726,866 to Nally for a KNOCK-DOWN PLATFORM CONSTRUCTION clearly shows and exemplifies the essential elements of the conventional boxing/wrestling "ring", with a square (claimed as "rectangular") flat platform with posts at the four corners to hold the traditional triple set of constraint ropes surrounding the platform. This early example shows the platform elevated substantially above the surrounding floor area to a height that while optimal for general viewing, causes disadvantage to ringside spectators since they must look upwardly to view the action.

U.S. Pat. No. 3,876,107 to Jenson discloses a CIRCULAR BOXING RING on a flat circular platform with four corner posts suspending four firm circular constraint members at the location of conventional constraint ropes, with additional support from four auxiliary members.

U.S. Pat. No. 5,634,638 to Havens et al for a PORTABLE RETRACTABLE SPORTS ENCLOSURE discloses "a portable self-standing sports enclosure which may be opened and closed by a single person"; frame sections define a rectangular enclosed area but the patent does not disclose a performance platform or "ring".

There are several disadvantages of conventional boxing and wrestling "rings" and martial arts "cages" that detract from their entertainment value, viewer safety and overall benefit to the sport. The constraint ropes or fences in general and particularly the four corners of a square "ring" have tended to become traps into which a prevailing combatant inevitably forces a fading opponent, and the action then degenerates to illegal and foul activities such as holding the opponent and intentionally or unintentionally becoming entangled with the constraint rope structure. These and other defensive delays often require the referee to intervene, break up the impasse and get the action started again by moving the combatants back to the center of the ring and rematching them in a new faceoff.

Particularly in wrestling, combatants often get intentionally or unintentionally forced bodily over the ropes and into the audience, risking injury both to the combatants and to spectators in the ringside seats, or at least causing distraction and disrupting the flow of action.

More recent developments for personal combat sports such as martial arts have included performance areas such as "cages" that are not rectangular but, for example, round, hexagonal or octagonal. While the peripheral constraint structure is still typically substantially vertical and extends to no more that chest height, one approach utilizes stiff chain-link fence extending vertically to a full height, e.g. at least six feet.

The abovementioned and other known art all utilize a platform that is strictly flat throughout its area; and where there is peripheral constraint structure, such as posts and ropes or chain link fencing, the constraint structure extends upwardly in a strictly vertical direction, i.e. strictly perpendicular to the platform.

OBJECTS OF THE INVENTION

It is a primary object of the invention to provide a platform for martial arts that eliminates conventional corner posts, ropes or vertical steel fencing and the like, and thus avoids interruptions and delays in the sports action caused by combatants holding or otherwise suspending action, particularly utilizing the ropes and corners of the constraint structure.

It is a further object to configure the platform in a manner that tends to confer advantage to a combatant who has been or is being forced back toward the edge of the platform, so that the configuration will automatically tend to urge the combatants and their activities to gravitate back toward the center region of the platform and thus sustain the action without delay or interruption.

It is a still further object to equip the platform with novel surround constraint structure that serves better than the conventional constrain structures, such as ropes and posts, to more fully protect both ringside spectators and combatants, while still providing practically all of the spectators with optimal viewing of the sports action.

It is a still further object to configure the constraint structure in a manner that will not only prevent combatants from being ejected bodily from the platform, but that will also function elastically when a region has been contacted and displaced by a combatant moving too close to the outside edge of the platform, in a manner that tends to force the combatant back toward the central region of the platform.

It is a still further object to configure the platform in a manner that will afford more comfortable viewing to ringside spectators by lowering the elevation of the primary platform floor region and thus of the combatants, relative to the arena floor.

SUMMARY OF THE INVENTION

The above objects and advantages have been realized by the present invention of a circular martial arts performance platform wherein, in a departure from conventional flat platforms utilized in known boxing/wrestling/martial arts rings, the novel platform is configured in a non-flat upwardly-facing concave shape, typically having a flat central region intended for the sports activity, surrounded by an inclined border region that slopes upwardly toward the outer edge of the platform. In another key feature of the present invention, instead of the conventional corner posts and ropes, and strictly vertical orientation, a constraint net is made to extend up from the outer edge of the platform, sloping inwardly to a substantially smaller top opening. The constraint net is preferably made to extend to a full height substantially exceeding the height of the combatants.

In a preferred embodiment, the platform is made circular in shape, about twenty four feet in diameter, with the flat central area being made circular and concentric, about twelve feet in diameter, thus surrounded by a region six feet that slopes upwardly to the outer edge, typically with an incline of one inch per foot.

The concave platform shape tends to temporarily restore the "upper hand" to a combatant who has been forced to back out of the flat central region onto the inclined region to "higher ground", where the force of gravity is active at all times, tending to move the combatant(s) back into the flat central region and to thus avoid the distracting interruptions that occur commonly with events staged on conventional flat-platform sports rings. Thus, for equal opponents, whenever one of them moves or is forced into the sloped region, the sports action tends to automatically gravitate back toward the flat central region and thus the action becomes sustained continuously without interruption.

The constraint net in this embodiment extends up from the outer edge of the platform, inclined inwardly to a substantially smaller circular top opening at a full height that substantially exceeds the height of the combatants. The net is made as a mesh grid or network of filaments of a strong flexible material such as nylon to make the net strong enough to prevent combatants from being expelled bodily from the ring, and yet resilient enough to simply stretch and safely return the combatant(s) back into the ring to keep the action flowing. The filament material of the net is made thin enough and the mesh grid size is made large enough to not interfere appreciably with satisfactory spectator viewing of the action. A preferred grid size of about one inch discourages combatants (typically gloved) from grasping the constraint net to avoid a takedown, which occurs commonly with conventional constraints such as ropes or chain link fencing. The invention can be practiced with net material of a type commonly utilized in golf driving ranges.

The constraint net is preferably suspended from overhead in an arena so that no support structure interferes with spectator viewing. In a stand-alone version e.g. for outdoors, the net may be suspended from or supported by an arched support structure having several members, e.g. four rods, extending from fastenings at the outer edge of the platform and arching inwardly to a common hub or ring at the top.

Entry and exit of combatants can be enabled by a door-flap configured in the net or arranging for a portion of the lower edge of the net to be liftable for access.

DETAILED DESCRIPTION

Figure 1:
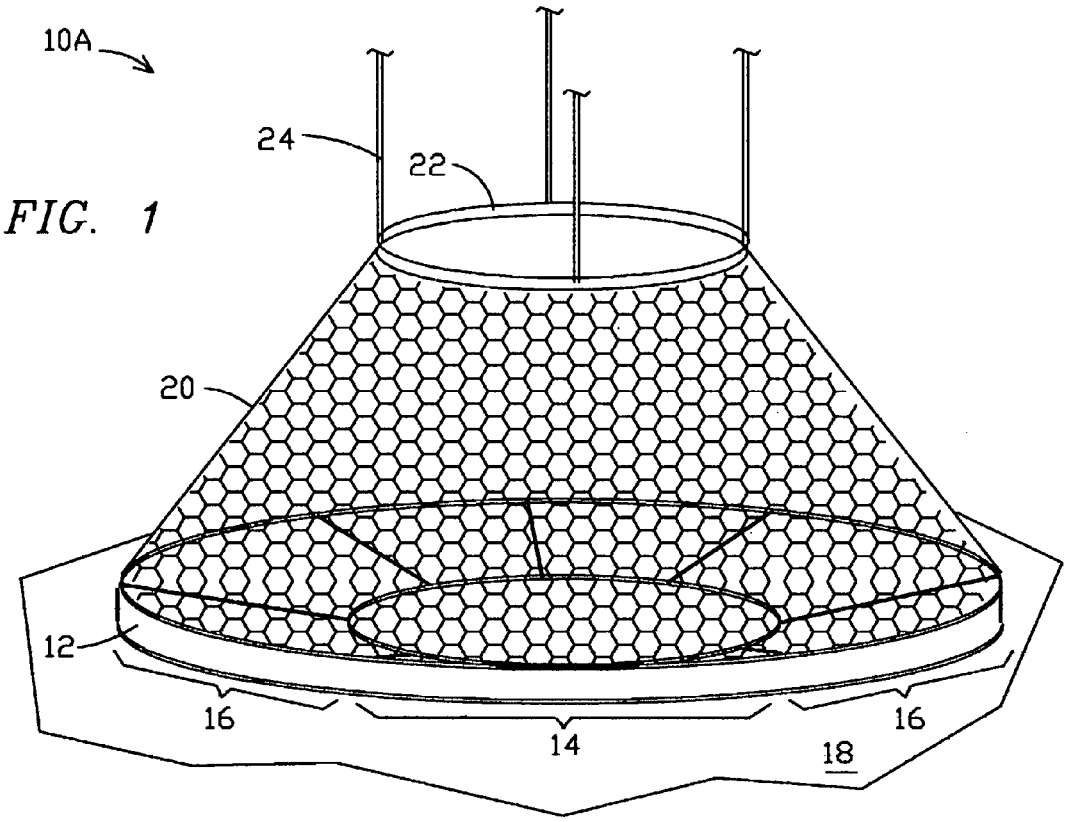
FIG. 1 is a three-dimensional view of a martial arts ring implemented in a circular configuration in accordance with a preferred indoor embodiment of the present invention.

FIG. 1 is a three dimensional view of an overhead-suspended circular martial arts ring 10A as an illustrative first embodiment of the present invention for typically indoor environments where overhead structure is available for net suspension. A circular concave platform 12 is configured with a concave upper surface of which a substantially flat circular central region 14 is surrounded concentrically by an inclined border region 16. The platform 12 rests on a flat floor or ground region 18. Attached to the outer edges of platform 12 and extending upwardly therefrom, an inverted-cone-shaped constraint net 20 converges to an upper ring 22 to which net 20 is attached. Ring 22 is typically suspended from building structure above, by several support members 24 which may be rods, chains, cables, tubing, electrical conduit or any tensile members suitable for this function. Members 24 are preferably made somewhat elastic longitudinally at least in part utilizing bungee cords, coil springs or other stretchable items, so as to keep net 20 moderately taut with stress shared between the net 20 and the support members 24 so as to allow the overall structure to absorb and recover from any impact on net 20.

As indicated above, the net 20 is made from tough thin filament netting material, e.g. equivalent to nylon netting as utilized in golf driving ranges and tennis courts. The net 20 is typically configured to provide a closable flap or door to allow entry and exit of combatants. The top surface area of platform 12 may be covered with padding, at least in the flat region 14. Padding may be provided in the inclined border region 16 in the form of individual mats in the shape of the sectors indicated.

Figure 2:
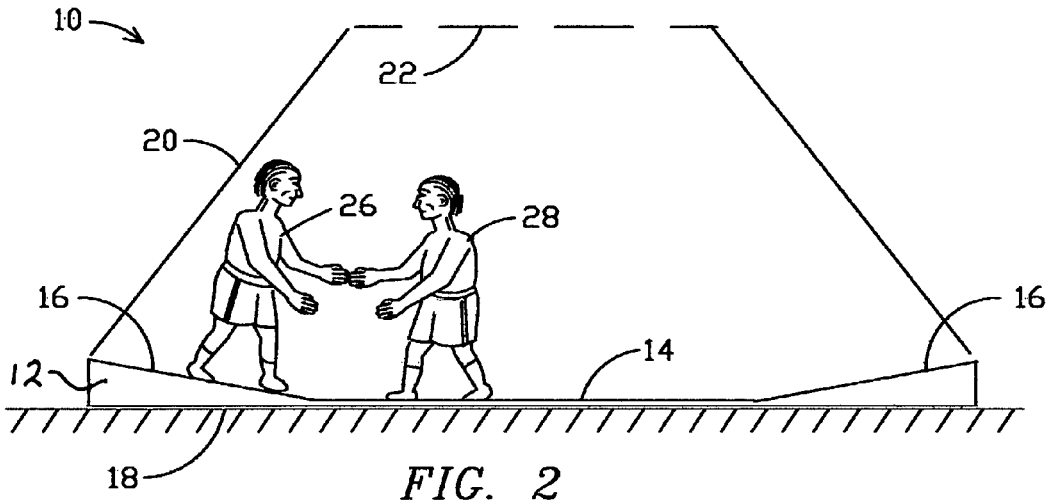
FIG. 2 is a cross-sectional outline of the martial arts ring of the present invention showing two combatants.

FIG. 2, a central cross-sectional elevation of the general outline of a martial arts ring 10 of the present invention, e.g. the embodiment in FIG. 1, shows two combatants performing within the ring on platform 12. Combatant 26, located on the inclined region 16, benefits from the effect of earth's gravity at his relatively elevated location on the inclined region 16 and thus gains a competitive advantage over combatant 28 located on the lower flat region 14. Typically from this situation, the fight activity will strongly tend to move back to the flat region 14 as combatant 26 exploits his advantage and fights his way forwardly, down and off the inclined region 16.

Combatant 26, as shown, is located close to the constraint net 20; if he moves back and comes into contact with the net 20, he will first feel the net against his head and shoulders, and thus will be further motivated him to press his gravitational advantage and move the action forward and back down onto the flat region 14. The net 20 is made strong enough to prevent a combatant from being ejected bodily, but is intended to respond to attempted bodily ejection or "tangling" by stretching resiliently and acting in the elastic manner of a catapult to return a combatant's body back into the ring safely. Furthermore, the resilient constraint net 20 of the present invention, configured full height and shaped as shown, totally prevents bodily ejection that occurs frequently in conventional half-height rope-constrained rings, and greatly reduces risk of combatant injury compared to known sports enclosures of the type that utilize constraints made from strong steel link fencing that are typically made full height and perpendicular to the floor.

Figure 3:
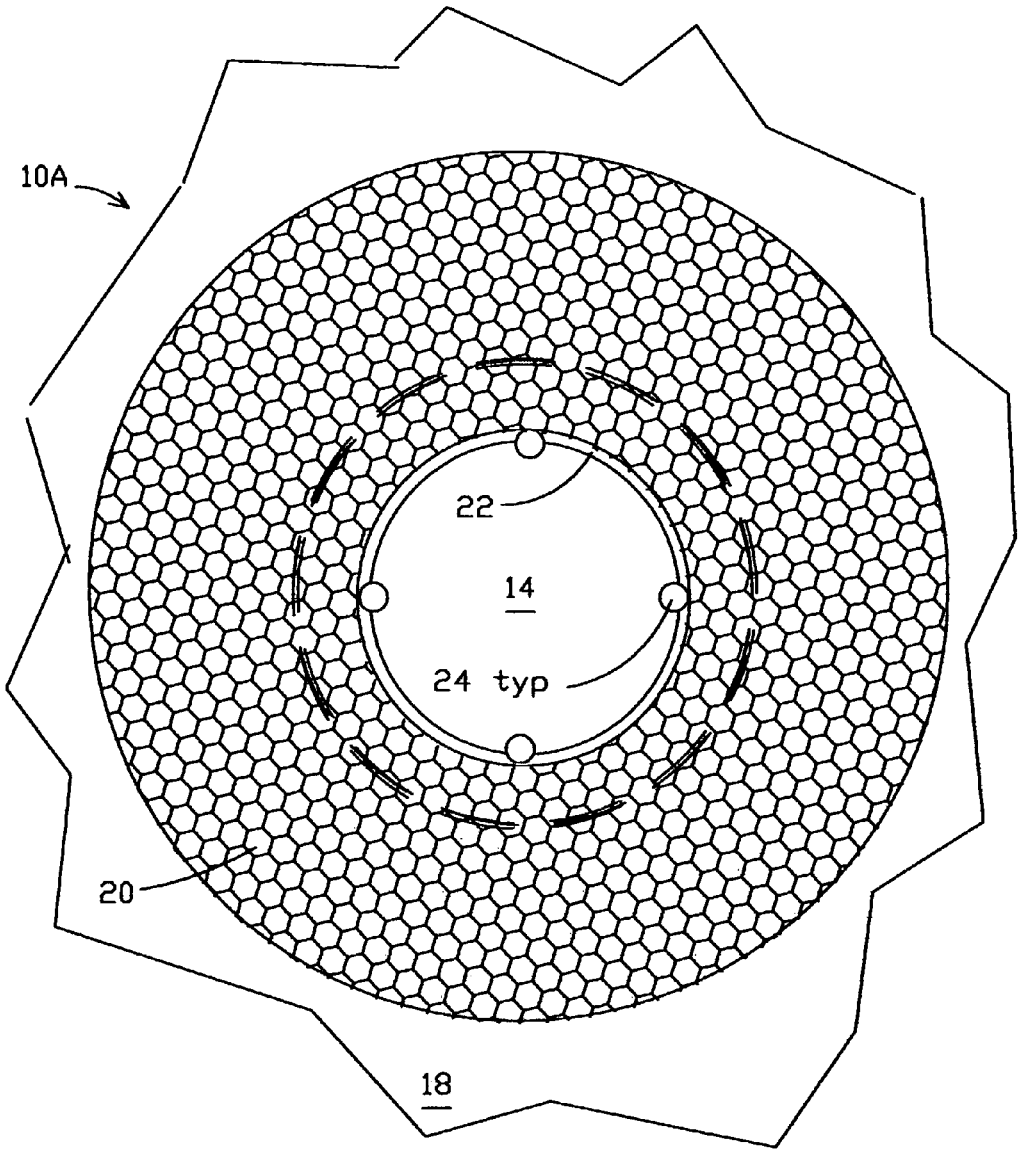
FIG. 3 is a top view of the martial arts ring of FIG. 1.

FIG. 3 is a top view of the first embodiment overhead-suspended circular martial arts ring 10A of FIG. 1 showing ring 22 and the four overhead suspension members 24. The perimeter of the flat portion 14 of the top platform surface is shown as a dashed outline, surrounded by the inclined portion. Typically the platform is sized to have about twice the diameter of the flat region 14, thus the total platform area is about four times that of the flat region 14.

Figure 4:
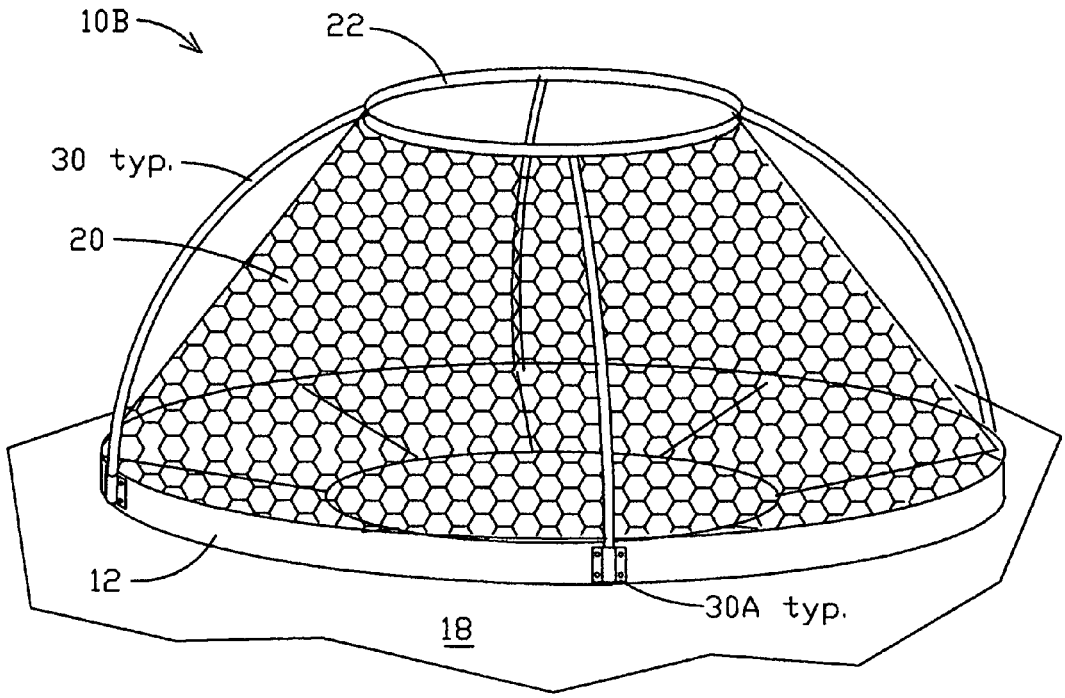
FIG. 4 is a three-dimensional view of a martial arts ring implemented in accordance with an indoor/outdoor stand-alone circular embodiment of the present invention.

FIG. 4 is a three-dimensional view of a stand-alone circular embodiment of a martial arts ring 10B in accordance with the present invention. The constraint net 20 and platform 12 are essentially the same as in FIG. 1, however, instead of overhead suspension which may not be practicable in some locations, e.g. in outdoor venues, net 20 is supported by a set of arched support members 30 attached to the outer edge of platform by brackets 30A or equivalent fasteners and extending upwardly to attachment points on upper ring 22 as shown. Preferably support members 30 are made of material that is sufficiently resilient to keep the net 20 moderately taut with the ability to absorb and recover from practically any impact that might occur. Members 30 and/or ring 22 could be made hollow to serve as electrical conduits.

Figure 5:
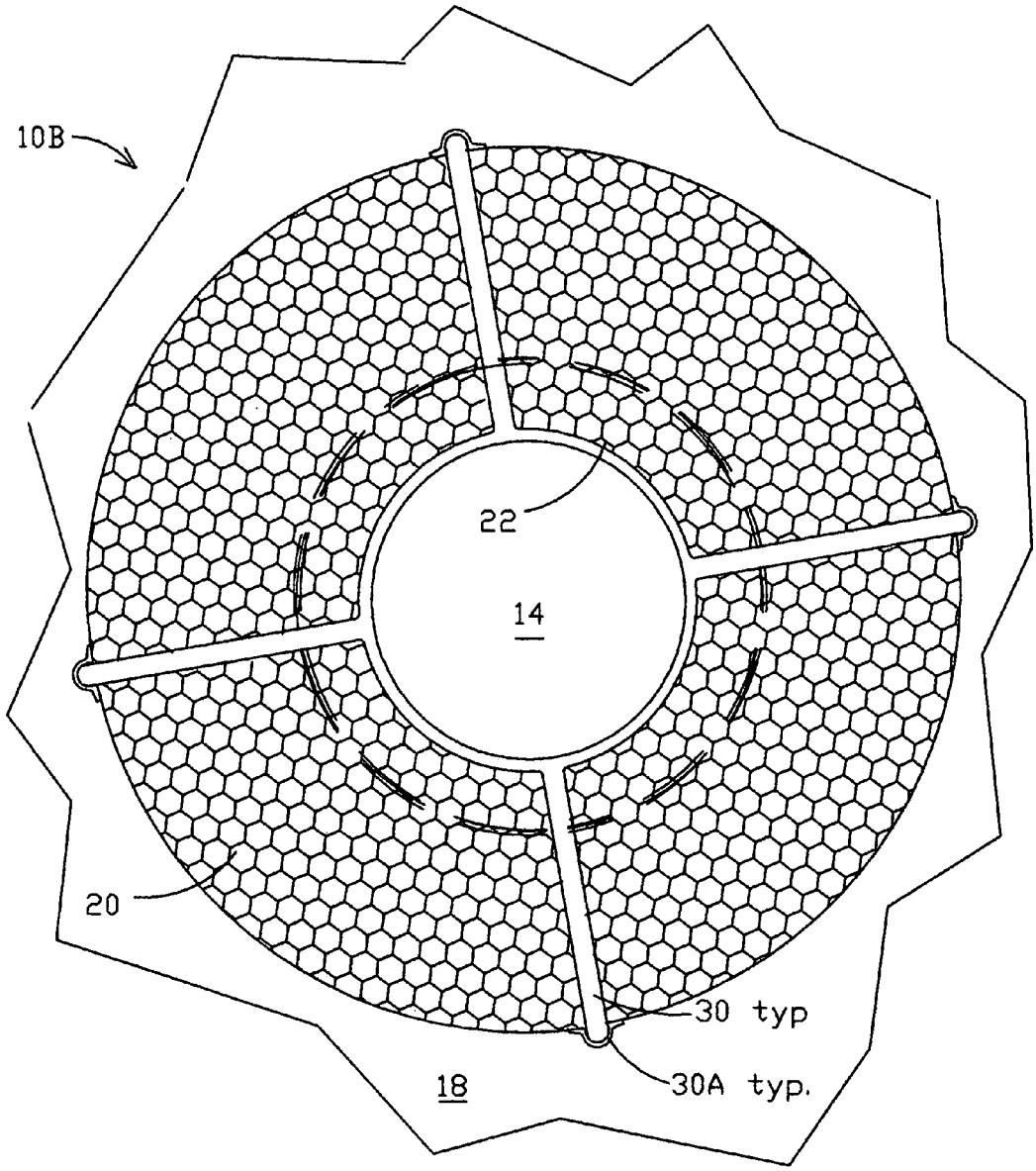
FIG. 5 is a top view of the martial arts ring of FIG. 4.

FIG. 5 is a top view of the stand-alone version of the martial arts ring 10B of FIG. 4 showing four support members 30 located in a radial array, attached to upper ring 22 supporting net 20 and to the outer edge of the platform by brackets 30A or other fasteners.

The circular shape of platform 12 (FIGS. 1, 2, 4) and upper ring 22 shown in the illustrative embodiments is believed to be preferable, however the invention could be practiced with other shapes such as a polygon, i.e. triangular, square, hexagonal etc., or elongated to an oval or rectangular shape. Similarly the shape of the upper ring 22 could be made different from circular or even different from the shape of platform 12.

In the main feature of the invention, the concave configuration of the platform 12 the invention may be practiced with concave shapes other than that shown in FIG. 2 where in cross-section the two portions each have a straight line profile. Alternatively all or a portion of this cross-sectional shape could be made curved, for example the cross-sectional shape of a portion of a circular or elliptical sphere.

The central flat region 14 (FIG. 2) can be made as part of platform 12 or alternatively left open so that the flat region 14 is provided by a floor indoors or a ground region outdoors, in either case typically covered by a canvas or pad.

The inclined region 16 (FIGS. 1, 2) could be built as a single unit constituting the major portion of platform 12 or could be made from a polar array of individual separate sectors, e.g. eight sectors as indicated in FIG. 1, fastened side-by-side or by an external circumferential clamp band. Especially if more and narrower sectors are utilized and made from somewhat compliant material such as cellular plastic foam, it would be possible to adjust the overall size of the platform 12 by selection of the quantity of sectors utilized: the width of the inclined border region 16 would remain substantially the same, typically eight feet, while the size of the flat region 14 would vary as a function of the overall size selected.

Amongst other alternatives and embellishments with which the present invention could be practiced, the structure could be made to serve as support for audio, video or lighting apparatus including illumination, spot lights and/or light show effects such as laser beam displays, and the like, other advertising media, etc. The concept of a non-flat top platform surface could be expanded to many alternate shapes including a raised central region.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. A sports enclosure for staging personal combat events for spectator viewing, comprising:

a platform made and arranged to provide a substantially firm flat level unobstructed central region for main combat activity surrounded by an inclined firm border region that is made at least three feet wide in any radial direction from a center point of the central region and made to slope upwardly toward a periphery of said platform, whereby the main combat activity tends to remain largely confined to the central region due to a temporary advantage, gained by a combatant who has been forced into the inclined border region, that tends to cause the combat activity to automatically gravitate back into the central region without need for official intervention; and constraint means attached around the periphery of said platform and extending generally upwardly.

2. The sports enclosure as defined in claim 1 wherein the periphery of said platform is made circular in shape and the central region is made circular in shape, concentric with the periphery.

3. The sports enclosure as defined in claim 2 wherein said constraint means comprises:

a constraint net, made of filament material, arranged in a mesh pattern to be substantially resilient, strong enough to prevent bodily ejection of a combatant, and sufficiently open to facilitate spectator viewing of events within the enclosure, said net being attached, at a lower edge thereof, around the periphery of said platform and extending upwardly to an upper edge; and net support means for supporting said constraint net at the upper edge thereof in a working location above said platform in a substantially taut manner such that all regions of said constraint net, other than the upper and lower edges, are held substantially separated from any structural items of said sports enclosure.

4. The sports enclosure as defined in claim 3 wherein said net support means comprises an open circular top support member attached to the upper edge of said constraint net.

5. The sports enclosure as defined in claim 4 wherein said top support member is suspended in place from overhead structure.

6. The sports enclosure as defined in claim 4 wherein said top support member is suspended in place by a plurality of support struts each having a first end attached to said support member and extending radially and downward to a second end supported from attachment locations around the periphery of said platform.

7. The sports enclosure as defined in claim 4 wherein said constraint net is shaped to slope inwardly toward a central axis of the main central region and is thus disposed non-perpendicular to the ground surface, and accordingly said open circular top support member is made smaller in diameter than the periphery of said platform.

8. The sports enclosure as defined in claim 3 wherein said constraint net is configured with a closable opening made and arranged to enable combatant entry and exit.

9. The sports enclosure as defined in claim 3 wherein said platform is made with an open central region where the substantially flat level central region for main combat activity said platform is provided by an environmental flat ground floor area.

10. The sports enclosure as defined in claim 9 wherein said platform comprises a plurality of individual sector-shaped members arranged and fastened together side-by-side in a polar array.

11. The sports enclosure as defined in claim 10 wherein said plurality of sector-shaped members are each made from compliant material and fastened together in a removable manner such that said platform can varied in overall size and in size of the flat level main central region thereof by selection of quantity of said sector-shaped members assembled together to constitute said platform.

* * * * *